United States Patent [19]

McKay

[11] Patent Number: 5,027,465

[45] Date of Patent: Jul. 2, 1991

[54] LINT REMOVER

[76] Inventor: Nicholas D. McKay, G-9082 S. Saginaw Rd., Grand Blanc, Mich. 48506

[21] Appl. No.: 489,250

[22] Filed: Mar. 5, 1990

Related U.S. Application Data

[63] Continuation-in-part of Ser. No. 209,359, Jun. 20, 1988, Pat. No. 4,905,337.

[51] Int. Cl.[5] ..... A47L 25/00

[52] U.S. Cl. ..... 15/104 A; 428/43

[58] Field of Search ..... 15/104 A, 230.11; 428/43

[56] References Cited

U.S. PATENT DOCUMENTS

| | | | |
|---|---|---|---|
| 2,624,060 | 1/1953 | McKenzie | 15/104 A |
| 3,343,194 | 9/1967 | Ramelson | 15/104 A |
| 3,417,418 | 12/1968 | Ribound | 15/104 A |
| 4,427,726 | 1/1984 | Wolfrum | 15/104 A |
| 4,727,616 | 3/1988 | Kucera et al. | 15/104 A |

*Primary Examiner*—Paul T. Sewell
*Assistant Examiner*—Ted Kavanaugh
*Attorney, Agent, or Firm*—Miller, Morriss & Pappas

[57] ABSTRACT

A lint remover roller assembly having a pressure sensitive adhesive tape roll in association therewith wherein the pressure sensitive adhesive tape roll comprises layers of adhesive tape with the adhesive surface thereof facing outwardly so as to remove lint and/or other foreign particles from fabric surfaces over which it is rolled. The pressure sensitive adhesive tape roll is provided with a narrow non-adhesive side edge portion longitudinally along each side edge thereof which extends across the adhesive portion of the pressure sensitive tape roll from the inside edge of one of said non-adhesive side edge poritons of the inside edge of the opposite non-adhesive side edge portions so as to define a pair of spaced apart narrow unslit non-adhesive side edge portions which cooperate to maintain the retentive longitudinal continuous integrity of the adhesive tape roll while facilitating the selective detachable removal of the saturated top layer of the tape roll by lifting it away along the slit and tearing it away through the narrow unslit non-adhesive portions to expose the next lowermost unused adhesive tape layer.

11 Claims, 8 Drawing Sheets

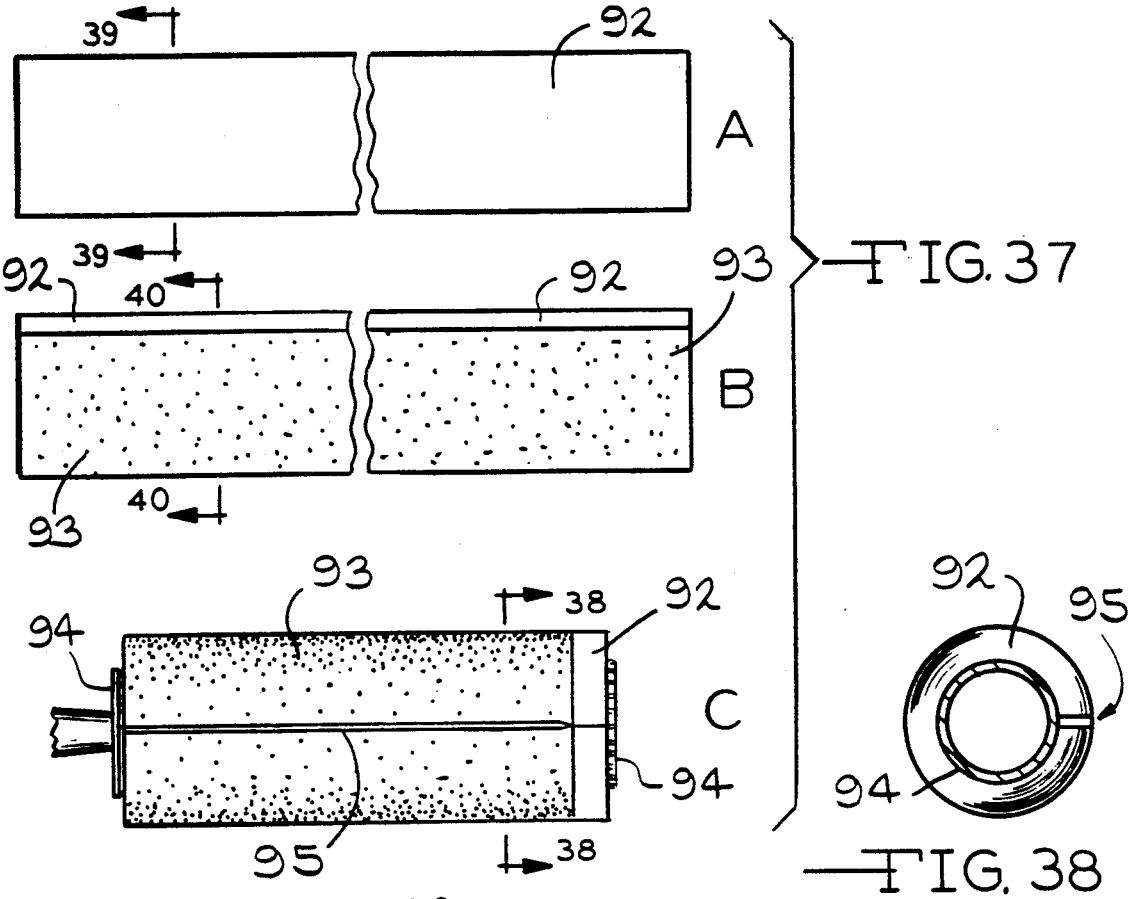
FIG. 37
FIG. 38
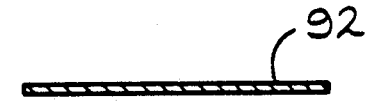
FIG. 39
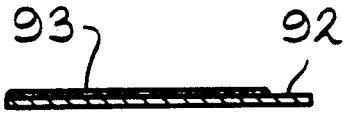
FIG. 40
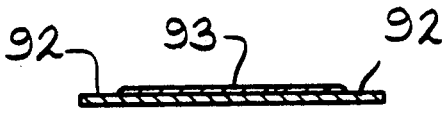
FIG 41
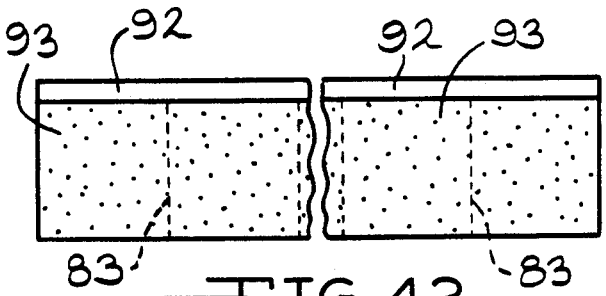
FIG. 42
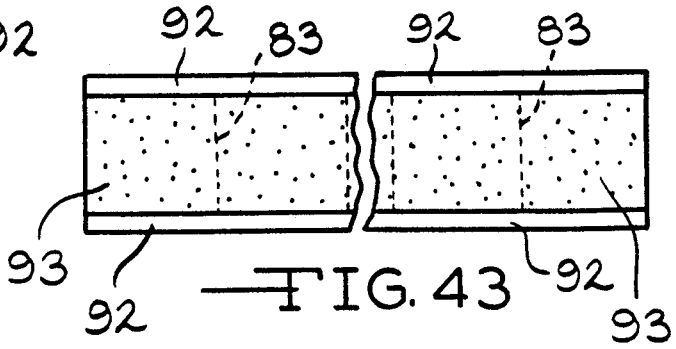
FIG. 43

LINT REMOVER

This invention relates to a lint remover roller assembly having a strip of pressure sensitive adhesive tape longitudinally wound into a roll thereon with the adhesive surface facing outwardly. More specifically the pressure sensitive adhesive tape roll is provided with at least one slit substantially therethrough which extends partially across the width of the pressure sensitive adhesive tape roll so that at least one selected narrow portion of the pressure sensitive adhesive tape roll is not slit so as to maintain the retentive longitudinally continuous integrity of the pressure sensitive adhesive tape roll upon the lint remover roller.

Several embodiments of the invention are hereinafter disclosed which include various types of slit configurations all of which include at least one portion of the pressure sensitive adhesive tape roll which is not slit so as to maintain the retentive longitudinally continuous integrity of the pressure sensitive adhesive tape roll upon the lint remover roller.

In use, the lint remover roller is rolled against the surface of the material so as to remove lint and other loose particles, such as threads, hair and the like therefrom. After the initial outer surface of the adhesive tape roll becomes saturated, it can be removed by lifting the leading edge of the tape roll and pulling it away from the next underlying adhesive surface. The relatively narrow unslit portion or portions of the tape roll are easily torn so that the saturated portion of the tape is easily removed along the slit and the unslit portion so as to expose the next underlying adhesive portion of the tape roll, ready for use in removing lint as required.

When that portion is saturated with lint and/or other foreign particles removed from the surface of the fabric being cleaned, the leading edge of the tape roll is lifted away from the underlying roll and the saturated portion is pulled off along the slit and easily torn away along the narrow unslit portion so as to fully expose the next underlying adhesive portion of the tape roll. This procedure is repeated after each exposed adhesive surface of the tape roll is utilized.

The devices of the prior art illustrate the use of tape rolls which utilize various slit configurations which extend transversely across the full width of the tape roll so as to slit the tape roll from one longitudinal edge to the other thereby fully severing the longitudinally continuous integrity of the tape roll. The devices of McKenzie U.S. Pat. No. 2,624,060 and Ramelson U.S. Pat. No. 3,343,194 are examples of prior art structures wherein the use of a traverse slit is disclosed which extends across the entire width of the tape roll.

In summary, the instant invention utilizes a transverse slit which does not extend fully across the entire width but only partially thereacross so as to maintain at least one narrow unslit portion which preserves the retentive longitudinally continuous integrity of the pressure sensitive adhesive tape roll upon the lint remover roller.

Nowhere in the prior known art is there shown a pressure sensitive adhesive tape roll which is provided with at least one slit substantially therethrough which extends only partially across the width of the tape roll so that at least one selected narrow portion of the tape roll is not slit so as to maintain the retentive longitudinally continuous integrity of the pressure sensitive adhesive tape roll upon the lint remover roller.

Further, nowhere in prior known art is there shown a washable adhesive plastic tape roll which is provided with at least one slit substantially therethrough which extends only partially across the width of the tape roll so that at least one selected narrow portion of the tape roll is not slit so as to maintain the retentive longitudinally continuous integrity of the pressure sensitive adhesive tape roll upon the lint remover roller.

Yet another object of this invention is to provide a partially slit pressure sensitive adhesive tape roll which maintains its retentive longitudinally continuous integrity upon the lint remover roller upon which it is wound so as to not inadvertently splay away therefrom in use.

It is therefore an object of this invention to provide a pressure sensitive adhesive tape roll having at least one slit substantially therethrough which extends only partially across the width of the tape roll so that at least on selected narrow portion of the tape roll is not slit so as to maintain the retentive longitudinally continuous integrity of the pressure sensitive adhesive tape roll upon the lint remover roller.

Another object of this invention is to provide a lint remover roller having a strip of pressure sensitive adhesive tape longitudinally wound into a roll thereon with the adhesive surface facing outwardly with at least one slit substantially through the tape roll which extends only partially across the width of the tape roll so that at least one selected narrow portion of the tape roll is not slit so as to maintain the retentive longitudinally continuous integrity of the tape roll upon the lint remover roller thereby preventing inadvertent splaying of the tape roll away from the lint remover roller.

Other objects and advantages found in the construction of the invention will be apparent from a consideration of the following specification in connection with the appended claims and the accompanying drawings.

IN THE DRAWINGS

Figure 23:
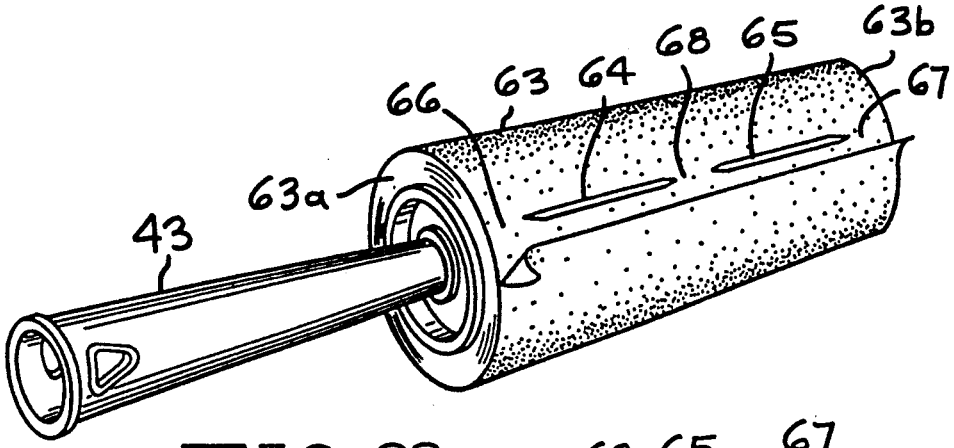

FIG. 23 is another embodiment of the invention illustrating the use of a washable plastic based pressure sensitive adhesive tape having a pair of elongate spaced-apart longitudinally aligned slits therethrough and defining three narrow unslit tape portions therebetween and along the edge portions of the tape proximate thereto so as to maintain the retentive longitudinally continuous integrity of the tape roll.

Figure 24:
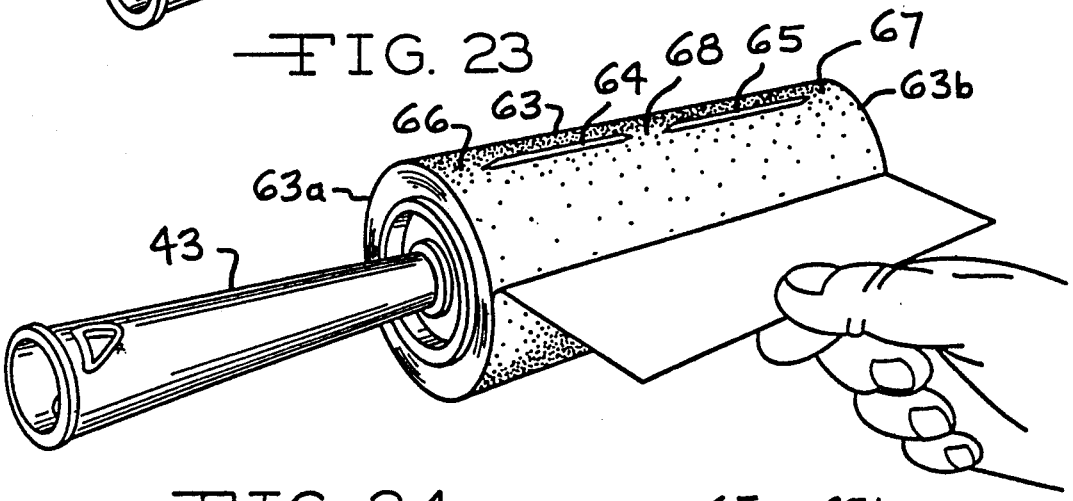

FIG. 24 is a schematic sequential view of the invention as shown in FIG. 23 illustrating the used portion of the washable tape being pulled away to expose the unused adhesive tape therebelow.

Figure 25:
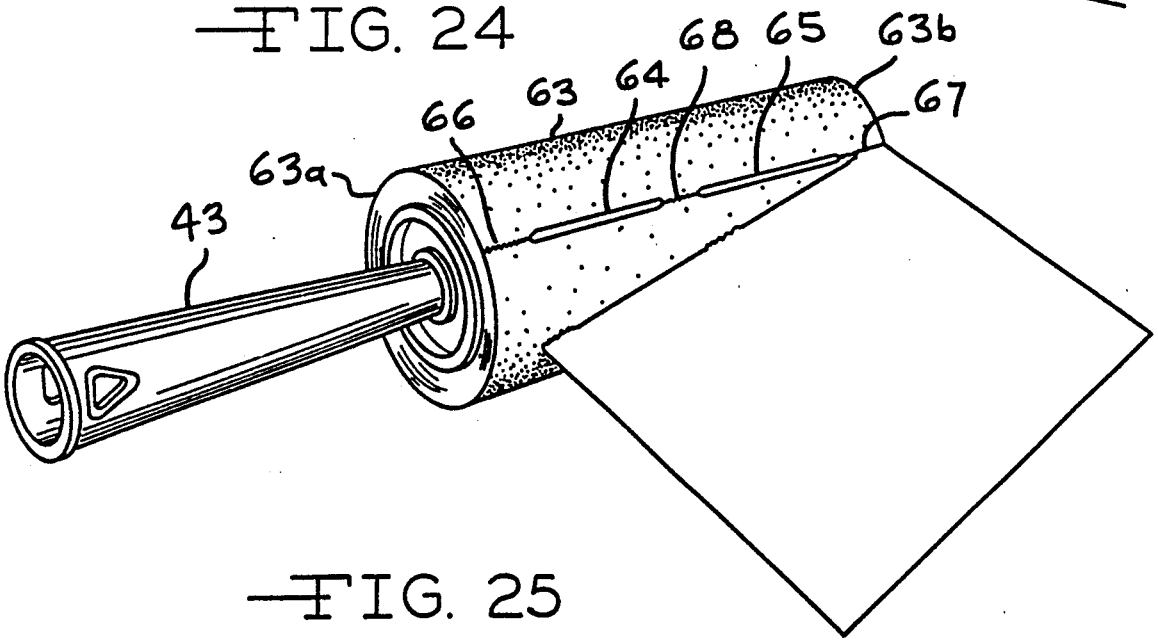

FIG. 25 is a schematic sequential view of the invention as shown in FIGS. 23 and 24 being removed along the slits and torn away across the unslit narrow portions of the washable tape.

Figure 26:
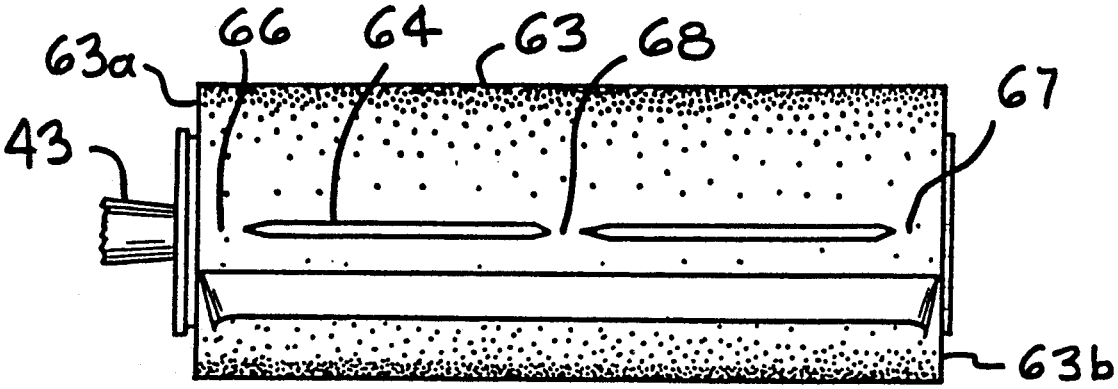

FIG. 26 is a partial plan view of the embodiment of the washable tape roll shown in FIG. 23.

Figure 27:
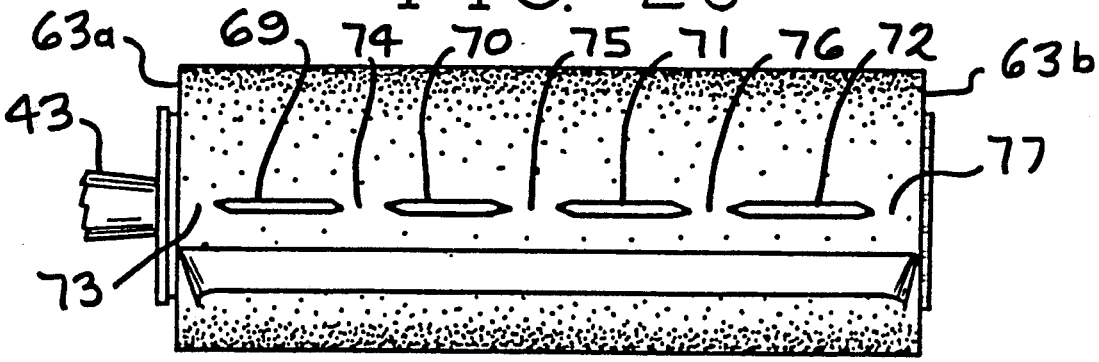

FIG. 27 is a partial plan view of an embodiment of the invention showing a washable plastic adhesive tape roll having four transversely oriented spaced apart longitudinally aligned slits therethrough which define five unslit tape portions which maintain the retentive longitudinally continuous integrity of the washable tape roll.

Figure 28:
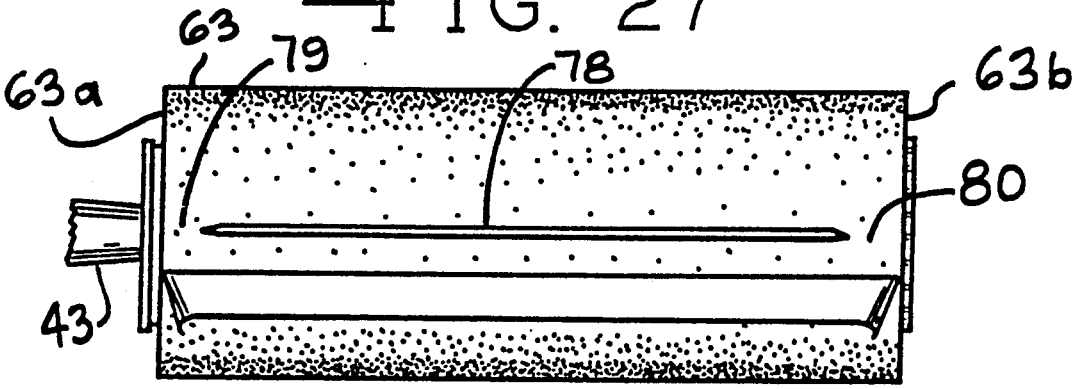

FIG. 28 is a partial plan view of an embodiment of the invention showing a washable plastic adhesive tape roll having a single elongate slit partially across the width thereof so as to define unslit portions along the sides thereof which maintain the retentive longitudinally continuous integrity of the tape roll.

Figure 29:
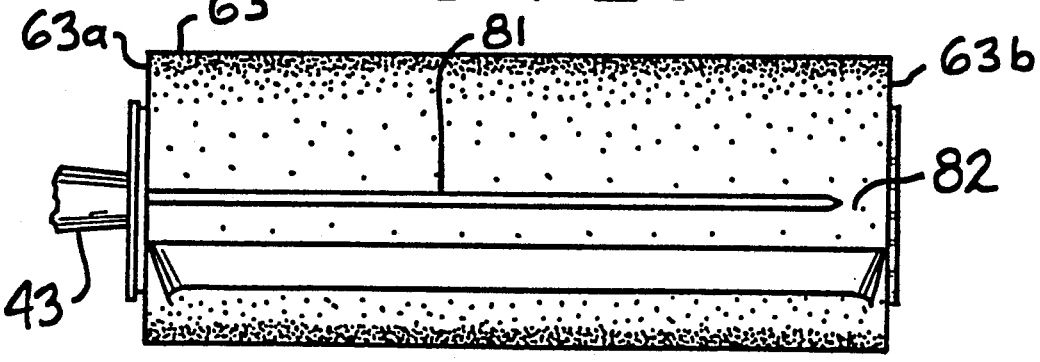

FIG. 29 is a partial plan view of an embodiment of the invention showing a washable plastic adhesive tape roll having a single elongate slit partially across the width thereof so as to define a narrow unslit portion along one side edge thereof which maintains the retentive longitudinally continuous integrity of the tape roll.

DESCRIPTION

Figure 1:
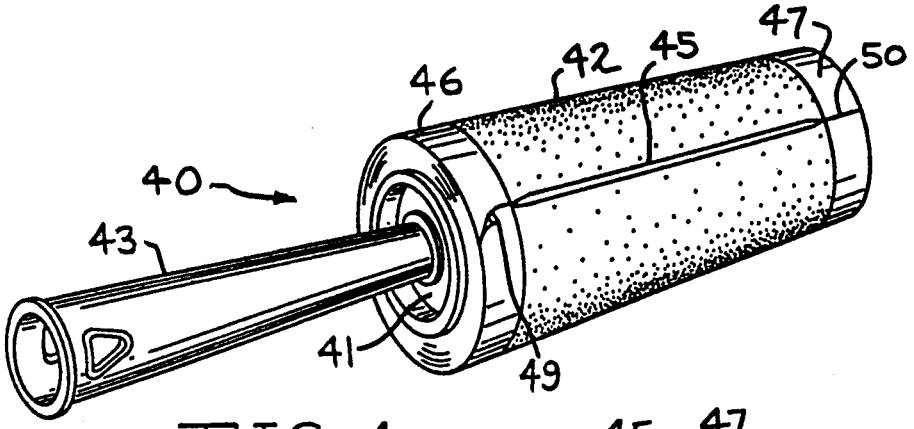
FIG. 1 is a perspective view of a lint remover roller with a pressure sensitive adhesive tape fully wound thereon and showing a slit in the tape roll extending partially transversely thereacross.
Figure 2:
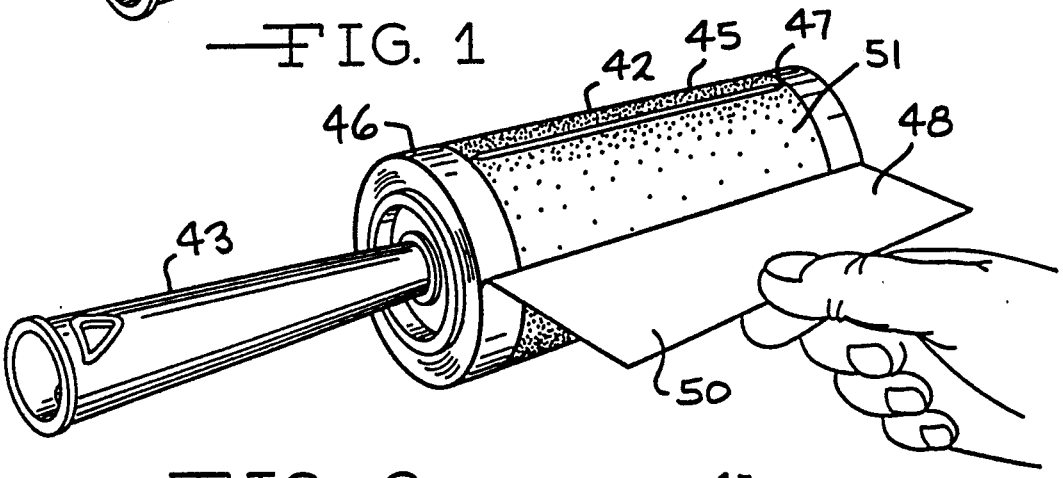
FIG. 2 is a perspective schematic view of the lint remover roller showing the used top layer of the tape roll partially removed.
Figure 3:
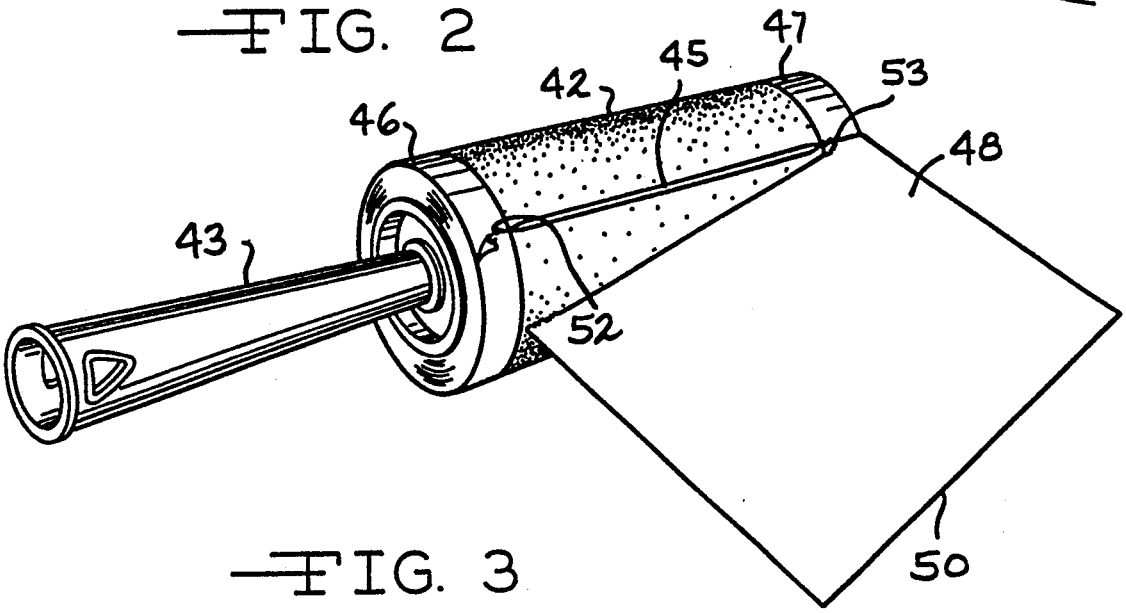
FIG. 3 is a perspective view of the lint remover roller showing the used top layer of the tape roll being separated from the unused tape roll along the slit and by tearing along the unslit portions.
Figure 4:
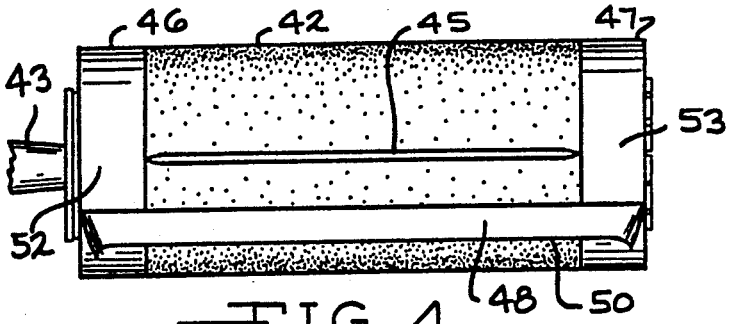
FIG. 4 is a partial plan view of an embodiment of the pressure sensitive adhesive tape roll having non-adhesive side portions with an intermediate partial slit extending therebetween.

As shown in FIGS. 1-3 a lint remover assembly 40 is provided with a roller assembly 41 having a pressure sensitive adhesive tape roll 42 mounted thereon which is adapted to remove lint, dust and other foreign materials from the surface of fabric and the like. While the embodiment of the lint remover assembly 40 shown in the drawings is shown with an axially aligned handle 43 extending outwardly from the roller 41, it is within the scope of the invention that the roller 41 be provided with any type of handle configuration such as the yoke or semi-yoke handles shown in the devices of the prior art as discussed herein. The type of handle used is not considered as an integral part of this invention as long as a handle is provided so that the roller 41 can be selectively rolled over a fabric surface so as to remove lint therefrom.

As described herein, the roller assembly 41 may consist of a cylinder 41 which supportably engages the core 44 thereon or may consist of circular end caps provided in association with the handle 43 and which are adapted to supportably engage the core 44 therebetween. The specific configurations of the roller support assembly 41 is well known in the art and is not considered a part of the invention.

The tape roll 42 consists of a strip of pressure sensitive adhesive tape longitudinally wound on itself or on a tubular core 44 with the adhesive surface facing outwardly so as to selectively engage the surface of any fabric against which it is rolled. The tape roll 42 is adapted to be slidably mounted over or otherwise be supported by the roller assembly 41.

The pressure sensitive adhesive tape utilized can consist of a saturated release coated crepe paper, pulled out paper or flat back paper or can be fabricated utilizing a flexible washable plastic substrate of poly vinyl or other suitable washable plastic sheet material having a washable pressure sensitive adhesive coating provided on one side thereof. The adhesive coating provided on the flexible plastic substrate can also be a water base poly vinyl acetate so as to be washable so that each layer of tape can be used several times before being detached and discarded as hereinafter described.

As hereinafter described and shown in the drawings, the tape roll 42 is provided with at least one slit 45 substantially therethrough which extends partially across the width of the tape roll 42 so as to define a narrow unslit portion of the pressure sensitive adhesive tape which acts to maintain the retentive longitudinally continuous integrity of the tape roll 42 upon the core 44.

In the embodiment of the invention shown in FIGS. 1–4, the slit 45 is provided intermediate the non-adhesive side portions 46 and 47 selectively provided on tape roll 42. Thus positioned, the slit 45 defines unslit portions 52 and 53, respectively, between the ends of the slit 45 and the side edges of the tape 42. This embodiment of the tape roll utilizes the pressure sensitive adhesive tape having a paper substrate. The use of one or more non-adhesive side portions is well known in the prior art and is not considered as an integral part of this invention.

In use, the lint remover assembly 40 is selectively rolled over the surface to be cleaned so that the outer adhesive surface of the tape roll 42 removes the lint, dust and foreign particles therefrom as they adhere thereto. After the outer surface becomes saturated through repeated use, the outer used layer 48 can be removed as shown in FIGS. 2 and 3. This is initially accomplished by lifting the corner 49 of the leading edge 50 of the tape roll 42 and pulling the used layer 48 away from the tape roll 42 so as to expose the unused adhesive tape layer 51 therebelow. As shown in FIG. 3, the used layer 48 is severed from the tape roll 42 by selectively tearing it away along the narrow unslit portions 52 and 53 and lifting it away easily along the slit 45. After the used layer 48 is thus removed, the lint remover 40 is ready for use until the tape layer 51 is similarly saturated. The foregoing process is repeated until the entire tape roll is expended. A new refill tape roll is selectively installed on the roller assembly as desired. As previously discussed the slit tape roll 42 remains intact on the core 44 and/or roller 41 and does not splay open in use because the narrow unslit portions maintain the retentive longitudinally continuous integrity of the pressure sensitive adhesive tape roll on the core and/or roller.

As shown schematically in FIGS. 5, 6, 7 and 8, it is within the scope of the invention to utilize various types of slit configuration 45 partially across the width of the tape roll 42 as long as at least one narrow unslit portion 54, 55, 56 and 57, respectively, is provided so as to maintain the retentive longitudinally continuous integrity of the pressure sensitive tape roll.

Figure 5:
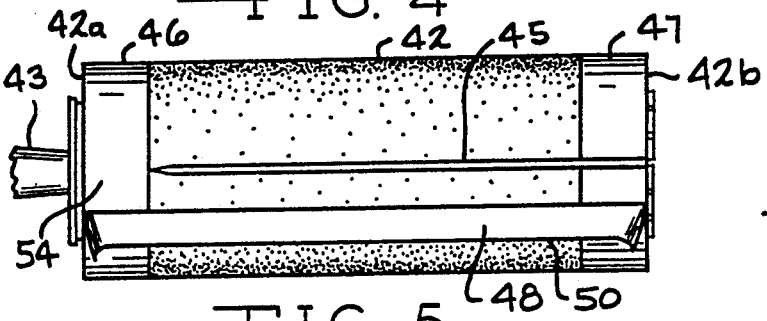
FIG. 5 is a partial plan view of an embodiment of the pressure sensitive adhesive tape roll having non-adhesive side portions with a partial slit extending from the inside edge of one of the non-adhesive side portions through the opposite non-adhesive side portion to the opposite edge of the tape roll.

As shown in FIG. 5, another embodiment of the invention illustrates a slit 45 which extends from the inside edge of the non-adhesive side portion 46 across the entire width of the tape roll 42 through the non-adhesive side portion to the opposite right side edge **42*b* of the tape roll 42 so as to define an unslit portion 54** which maintains the retentive longitudinally continuous integrity of the tape.

Figure 6:
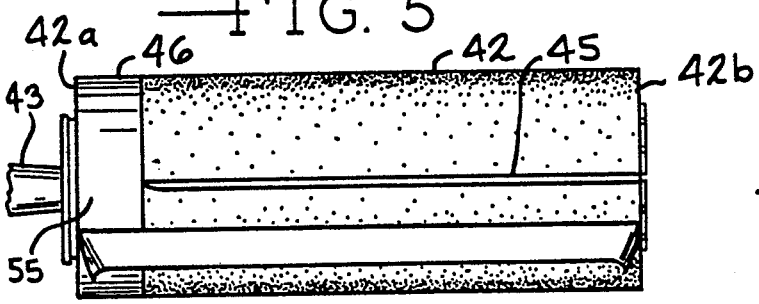
FIG. 6 is a partial plan view of another embodiment of the pressure sensitive adhesive tape roll having a single non-adhesive side portion with a partial slit extending therefrom to the opposite edge of the tape roll.

As shown in FIG. 6, yet another embodiment of the invention illustrates a slit 45 which is identical to the slit 45 shown in FIG. 5 but the tape roll is not provided with a non-adhesive side portion 47 along the right side thereof and which defines an unslit portion 55 which maintains the retentive longitudinally continuous integrity of the tape.

Figure 7:
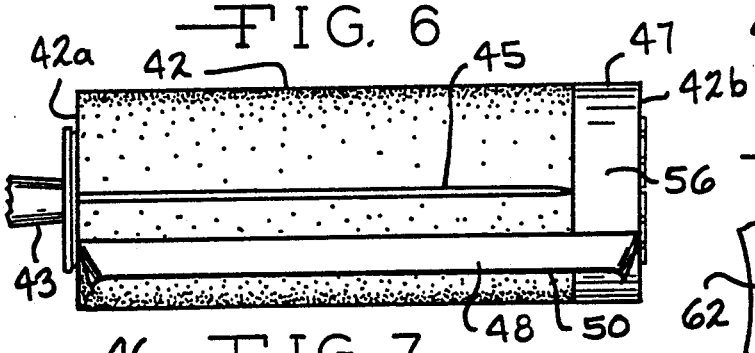
FIG. 7 is a partial plan view of an embodiment of the pressure sensitive adhesive tape roll having a slit configuration identical to but opposite that shown in FIG. 6.

As shown in FIG. 7, another embodiment of the invention is shown having the slit 45 extending from the left side edge **42*a* of the tape roll across the width of the tape to the inside edge of the non-adhesive portion 47 so as to define an unslit portion 56** which maintains the retentive longitudinally continuous integrity of the tape.

Figure 8:
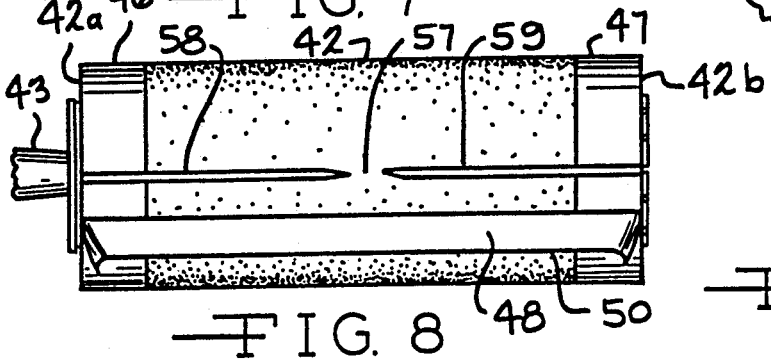
FIG. 8 is a partial plan view of an embodiment of the pressure sensitive adhesive tape roll having a pair of opposed longitudinally aligned spaced-apart slits extending inwardly respectively from the opposite edges of the tape roll so as to define a narrow unslit portion of the tape roll therebetween.

As shown in FIG. 8, another embodiment of the invention is shown having a pair of spaced-apart slits 58 and 59, respectively, extending inwardly from the side edges **42*a* and 42*b* of the tape 42 so as to define an unslit portion 57** therebetween which maintains the retentive longitudinally continuous integrity of the tape.

It is to be understood that the non-adhesive side portions provided on the tape itself are not considered to be an integral part of the invention and can be selectively used or eliminated partially or completely as desired as shown in the drawings.

Figure 9:
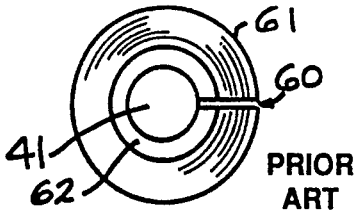
FIG. 9 is a schematic end view of an embodiment of the prior art showing the slit cut through the entire depth and width of the tape roll and of the core member upon which the tape is wound.
Figure 10:
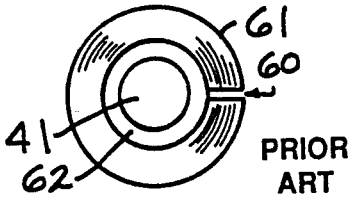
FIG. 10 is a schematic end view of an embodiment of the prior art showing the slit cut through the entire depth and width of the tape roll with the core remaining intact.
Figure 11:
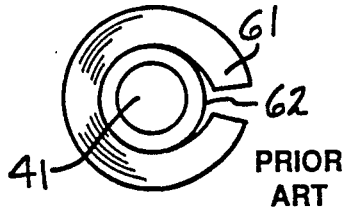
FIG. 11 is a schematic end view of the embodiment of the prior art shown in FIG. 10 showing the fully slit tape roll splaying open from the core.
Figure 12:
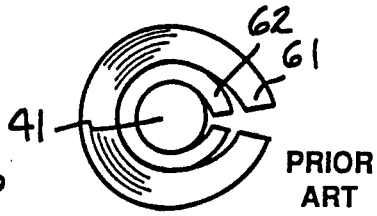
FIG. 12 is a schematic end view of the embodiment of the prior art shown in FIG. 9 showing the fully slit tape roll and core splaying open from the roller upon which they are mounted.

Various modifications of the full slit configurations utilized in the prior art are shown schematically in sectional views of FIGS. 9 through 14 wherein the prior art slit 60 extends entirely across the full width of the prior art tape roll 61 and/or the prior art core 62. For instance, as shown in FIG. 9, the prior art slit 60 is cut through the entire depth of the tape roll 61 and the core 62 and extends across the entire width thereof so as to sever the longitudinally continuous integrity of the tape roll. The corresponding view of FIG. 12 illustrates the manner in which the prior art core and tape roll could splay open and fail during actual use. FIG. 10 similarly shows a prior art slit configuration with the slit extending through the full depth of the tape roll and extending through the entire width thereof. The corresponding view of FIG. 11 shows the fully slit prior art tape roll splaying open from the core which is not slit.

Figure 13:
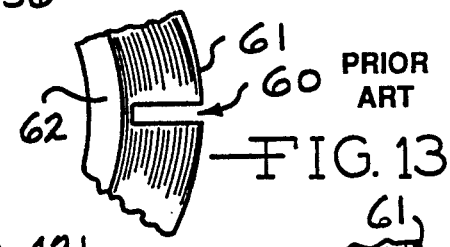
FIG. 13 is a schematic end view of an embodiment of the prior art showing the slit cut entirely through the entire width of the tape roll but only substantially and not entirely through the depth of the tape roll.
Figure 14:
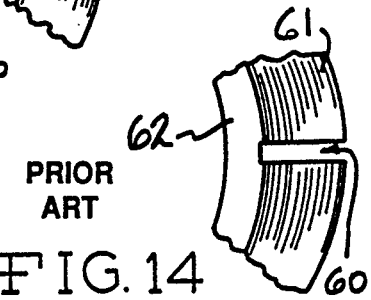
FIG. 14 is a schematic end view of an embodiment of the prior art showing the slit cut through the entire depth and width of the tape roll and only slightly into the core.
Figure 15:
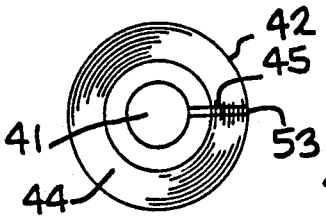
FIG. 15 is a schematic sectional view of one embodiment of the invention showing the tape roll with the slit partially thereacross with the narrow unslit portion which maintains the retentive longitudinally continuous integrity of the tape roll.
Figure 16:
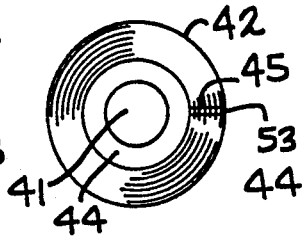
FIG. 16 is a schematic sectional view of another embodiment of the invention showing the tape roll with the slit partially thereacross with the narrow unslit portion which maintains the retentive longitudinally continuous integrity of the tape roll.
Figure 17:
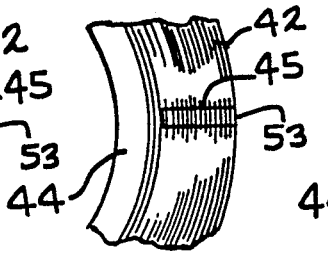
FIG. 17 is a schematic sectional view of an embodiment of the invention showing the tape roll with the slit partially thereacross with the narrow unslit portion which maintains the retentive longitudinally continuous integrity of the tape roll.
Figure 18:
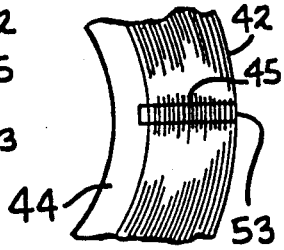
FIG. 18 is a schematic sectional view of an embodiment of the invention showing the tape roll with the slit partially thereacross with the narrow unslit portion which maintains the retentive longitudinally continuous integrity of the tape roll.

As more clearly shown in the partial enlarged schematic end view of FIG. 13, the prior art slit 60 extends across the entire width of the tape roll 61 so as to fully sever the longitudinally continuous integrity of the adhesive tape roll 61 on the core 62. As shown in FIG. 14, another configuration of the prior art slit 60 also extends across the entire width of the tape roll 61 so as to sever the longitudinally continuous integrity thereof.

The schematic end views of FIGS. 15 through 18 illustrate various depth configurations of the slit 45 of the present invention which do not extend the entire width of the tape roll 42 so as to define unslit portions 52, 53, 54 or 57, such as shown in FIGS. 4 through 8, which maintain the retentive longitudinally continuous integrity of the tape roll 42 upon the core 44. This is also shown in FIG. 3 and FIGS. 15 through 18.

Modifications of the instant invention are shown in FIGS. 19 through 22 wherein the slit 45 is shown in a diagonal position partially across the width of the tape roll 42 so as to define one or more unslit portions of the tape roll 42 so as to maintain the retentive longitudinally continuous integrity of the tape roll 42 upon the core 44. The embodiment of the invention shown in FIG. 19 corresponds to the embodiment thereof shown in FIG.

Figure 19:
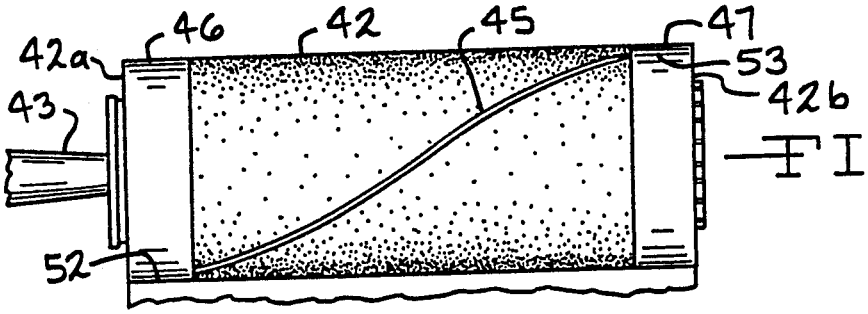
FIG. 19 is a plan view of an embodiment of the invention showing the tape roll having a diagonal slit provided intermediate the non-adhesive side portions of the tape as shown in FIG. 4.
Figure 20:
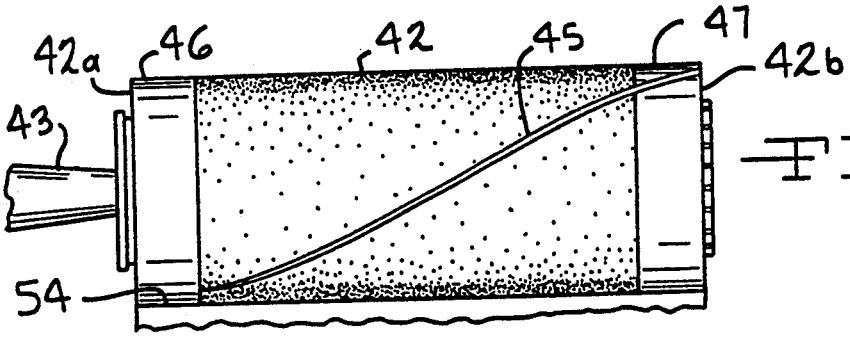
FIG. 20 is a plan view of an embodiment of the invention showing the tape roll having a diagonal slit provided from the inside edge of one non-adhesive side portion across the entire width of the tape roll through the opposite non-adhesive side portion to the opposite edge portion of the tape roll as shown in FIG. 5.
Figure 21:
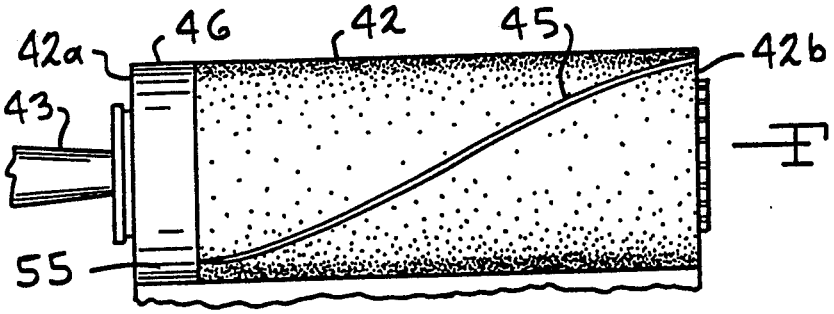
FIG. 21 is a plan view of an embodiment of the invention showing the tape roll having a diagonal slit provided from the inside edge of the left non-adhesive side portion across the entire width of the tape roll to the opposite edge portion thereof.
Figure 22:
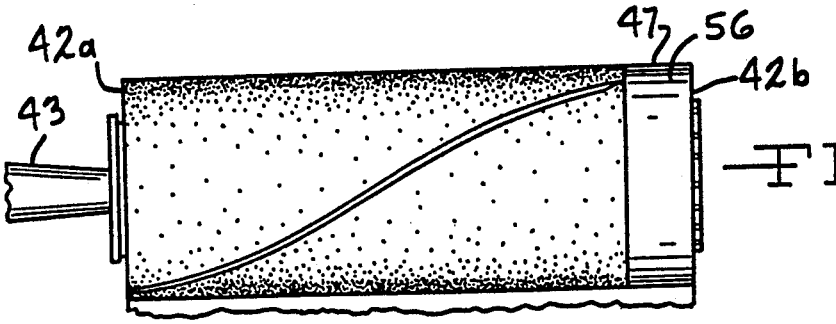
FIG. 22 is a plan view of an embodiment of the invention showing the tape roll having a diagonal slit provided from the left edge portion of the tape roll across to the inside edge portion of the right non-adhesive side portion.

4 with the exception the slit 45 in FIG. 19 is diagonal and will not be described again. Similarly, the embodiment of FIG. 20 corresponds to the embodiment shown in FIG. 5. Similarly, the embodiment of FIG. 21 corresponds to the embodiment shown in FIG. 6. Similarly the embodiment of FIG. 22 corresponds to the embodiment shown in FIG. 7. It is considered to be within the scope of the invention that the slit can have any desired type of curved, diagonal or serpentine configuration as it extends partially across the width of the tape roll 42 as long as it defines one or more unslit portions in the tape roll 42 which maintain the retentive longitudinally continuous integrity of the tape roll 42 upon its core 44.

Another embodiment of this invention is shown in FIGS. 23 through 29 wherein the tape roll 63 consists of a washable pressure sensitive adhesive tape comprised of a plastic substrate, one side of which has been coated with a pressure-sensitive adhesive coating. This type of washable adhesive lint remover is well known in the art and will not be described herein. Suffice it to say that the washable tape roll 63 has an outwardly facing adhesive surface and acts in the same manner as the embodiment 40 shown and described in FIGS. 1 through 22.

In the washable tape embodiment of the invention shown in FIGS. 23 through 26 the washable tape roll 63 is provided with two spaced apart slits 64 and 65, respectively, which define unslit portions 66 and 67, respectively, between the outer ends thereof and the side edges 63*a* and 63*b*, respectively, of the tape roll 63 and a centrally positioned unslit portion 68 therebetween. The unslit portions 66, 67 and 68 cooperate to maintain the retentive longitudinally continuous integrity of the tape roll 63. The washable tape lint remover as shown in the sequential views of FIGS. 23 through 25 functions in the same manner as the embodiment of the invention shown and described in FIGS. 1 through 3.

The embodiment of the invention shown in FIG. 26 is the same as the embodiment shown in FIGS. 23 through 25.

The embodiment of the invention shown in FIG. 27 illustrates a washable adhesive tape roll 63 which is provided with four spaced slits 69, 70, 71 and 72 which cooperate with each other and with the side edges 63*a* and 63*b* respectively, to define unslit portions 73, 74, 75, 76 and 77 therebetween which act to maintain the retentive longitudinally continuous integrity of the tape roll 63.

The embodiment of the invention shown in FIG. 28 illustrates a washable adhesive tape roll 63 provided with a single slit 78 which extends partially across the width of the tape roll 63 so as to define narrow unslit portions 79 and 80 proximate to the side edges 63*a* and 63*b*, respectively, so as to maintain the retentive longitudinally continuous integrity of the tape roll 63.

The embodiment of the invention shown in FIG. 29 illustrates a washable adhesive tape roll 63 provided with a single slit 81 which extends from the side edge 63*a* of the tape roll 63 partially across the tape roll 63 proximate to the opposite side edge 63*b* so as to define an unslit portion 82 adjacent thereto so as to maintain the retentive longitudinally continuous integrity of the tape roll 63 as herein described.

It should be noted that the slits described hereabove can be selectively provided diagonally partially across the width of the tape roll as described previously with respect to the embodiment of the invention shown and described in FIGS. 19 through 22. Further, the number of slits provided in any embodiment of this invention is not critical thereto as long as there is defined at least one narrow unslit portion so as to maintain the retentive longitudinally continuous integrity of the tape roll. In addition, it is not critical to the invention that a non-adhesive side portion be utilized therewith for such is known in the prior art.

Further, although not shown, it is considered to be within the scope of the invention for the pressure sensitive adhesive tape to be wound directly upon itself with the adhesive surface thereof facing outwardly and adapted for direct insertion upon the lint remover roller without the use of an intermediate core or sleeve element.

It is thus seen that a pressure sensitive adhesive tape roll is provided having layers of adhesive tape therein. As each outermost layer becomes saturated with lint and/or other foreign particles, it can be selectively detached from the roll by lifting it away along the slit and tearing it away through the unslit portion or portions so as to expose the next unused layer therebelow.

In summary, a lint remover assembly is provided with a handle member having a lint remover roller in association therewith which is adapted to supportably receive a pressure sensitive adhesive tape roll thereon having layers of adhesive tape with the adhesive surface facing outwardly so that the adhesive tape roll can be selectively rolled over a surface to selectively lift lint and/or other foreign particles therefrom. The pressure sensitive adhesive tape roll having an outwardly facing adhesive surface is adapted for selective mounting upon a lint remover roller. The pressure sensitive adhesive tape roll is provided with at least one slit substantially therethrough. The slit extends only partially across the width of the tape roll so as to define a narrow unslit portion in the tape roll which maintains the retentive longitudinally continuous integrity of the tape roll on the lint remover roller upon which it is mounted. Each layer of the tape roll is selectively detachable upon saturation by lifting it away along the slit and tearing it away through the narrow unslit portion so as to expose the next lowermost unused layer.

The pressure sensitive adhesive tape roll can be modified to have a narrow non-adhesive unslit portion longitudinally along one side edge thereof. The modified pressure sensitive adhesive tape roll has at least one slit substantially therethrough. The slit extends from the inside edge of the non-adhesive unslit portion partially across the width of the tape roll to the opposite side edge of the pressure sensitive adhesive tape roll so as to define a narrow unslit portion in the tape roll which maintains the retentive longitudinally continuous integrity of the tape roll on the lint remover roller upon which the tape roll is mounted.

The pressure sensitive adhesive tape roll can be further modified to have a narrow non-adhesive unslit side edge portion longitudinally along each side edge thereof. The thus modified pressure sensitive adhesive tape roll has at least one slit substantially therethrough. The slit extends from the inside edge of one of the narrow non-adhesive side edge portions partially across the width of the tape roll to the inside edge of the opposite non-adhesive unslit side edge portion so as to define a pair of spaced apart narrow unslit side edge portions which maintain the retentive longitudinally continuous integrity of the tape roll on the lint remover roller upon which the tape roll is mounted.

It should be noted that the slit in the foregoing embodiments can be selectively provided to extend diagonally partially across the width of the tape roll to facilitate selective removal of each layer from the tape roll after it has become saturated with lint and/or other foreign particles.

The pressure sensitive adhesive tape roll can be further modified so as to have at least one pair of spaced-apart longitudinally aligned slits which are provided partially across the width of the tape roll so as to define at least one narrow unslit portion therebetween which maintains the retentive longitudinally continuous integrity of the tape roll on the lint remover roller upon which it is mounted.

It should be further noted that in all of the modifications of the invention that the pressure sensitive adhesive tape roll can be selectively wound upon a core sleeve which is adapted to be selectively mounted upon the lint remover roller.

In another embodiment of the invention, a lint remover assembly is provided with a handle member having a lint remover roller in association therewith which is adapted to supportably receive a washable plastic based pressure sensitive adhesive tape roll thereon having layers of washable plastic based adhesive tape with the adhesive surface facing outwardly so that the washable plastic based adhesive tape roll can be selectively rolled over a surface to selectively lift lint and/or other foreign particles therefrom. The washable plastic based pressure sensitive adhesive tape roll having an outwardly facing adhesive surface is adapted for selective mounting upon a lint remover roller. The washable plastic based pressure sensitive adhesive tape roll is provided with at least one slit substantially therethrough. The slit which extends only partially across the width of the tape roll defines a narrow unslit portion in the tape roll which maintains the retentive longitudinally continuous integrity of the tape roll on the lint remover roller upon which it is mounted. Each layer of the tape roll is selectively detachable upon saturation by lifting it away along the slit and tearing it away through the narrow unslit portion to expose the next lowermost unused layer.

The washable plastic based pressure sensitive adhesive tape roll can be modified to have at least one pair of spaced-apart longitudinally aligned slits which extend partially across the width of the tape roll so as to define one narrow central unslit portion therebetween. Each of the slits extend proximate to its respective side edge of the tape roll so as to define a narrow side unslit portion at each edge of the tape roll. The narrow central unslit portion and the narrow unslit side portions cooperate to maintain the retentive longitudinally continuous integrity of the tape roll on the lint remover roller upon which it is mounted.

The washable plastic based pressure sensitive adhesive tape roll can be further modified to have a plurality of longitudinally aligned spaced apart slits which extend partially across the width of the tape roll so as to respectively define a plurality of narrow unslit portions in the tape roll which cooperate to maintain the retentive longitudinally continuous integrity of the tape roll on the lint remover roller upon which it is mounted.

Another embodiment of the washable plastic based pressure sensitive adhesive tape roll is provided with an elongate slit partially across the width of the tape roll so as to define a narrow unslit side portion in the tape roll proximate to each side edge thereof.

Figure 30:
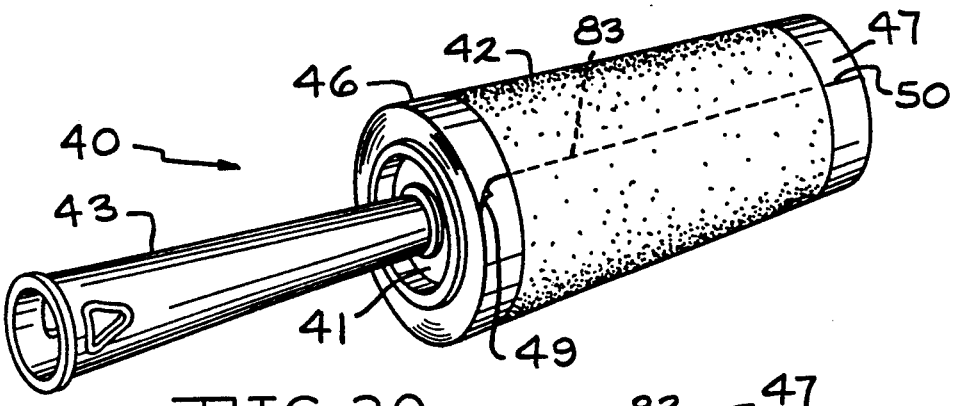
Figure 31:
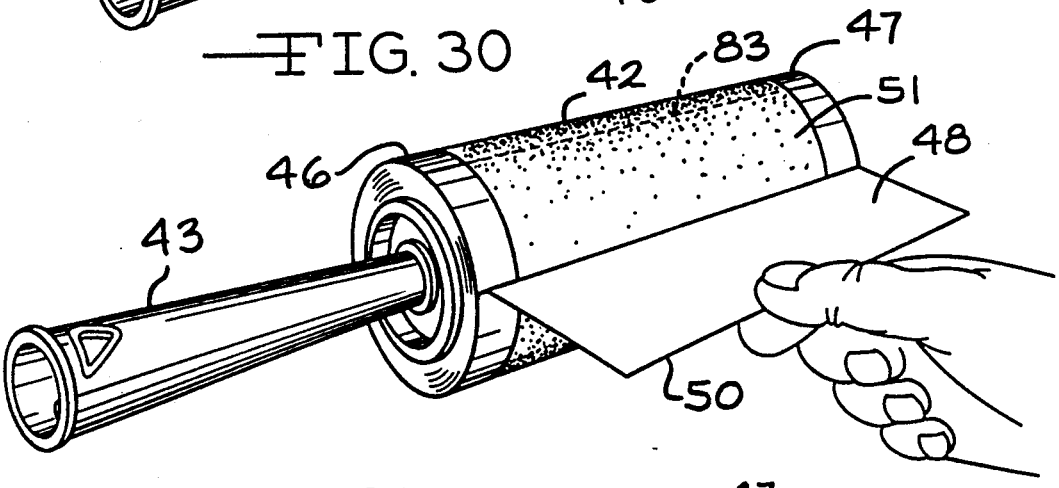
Figure 32:
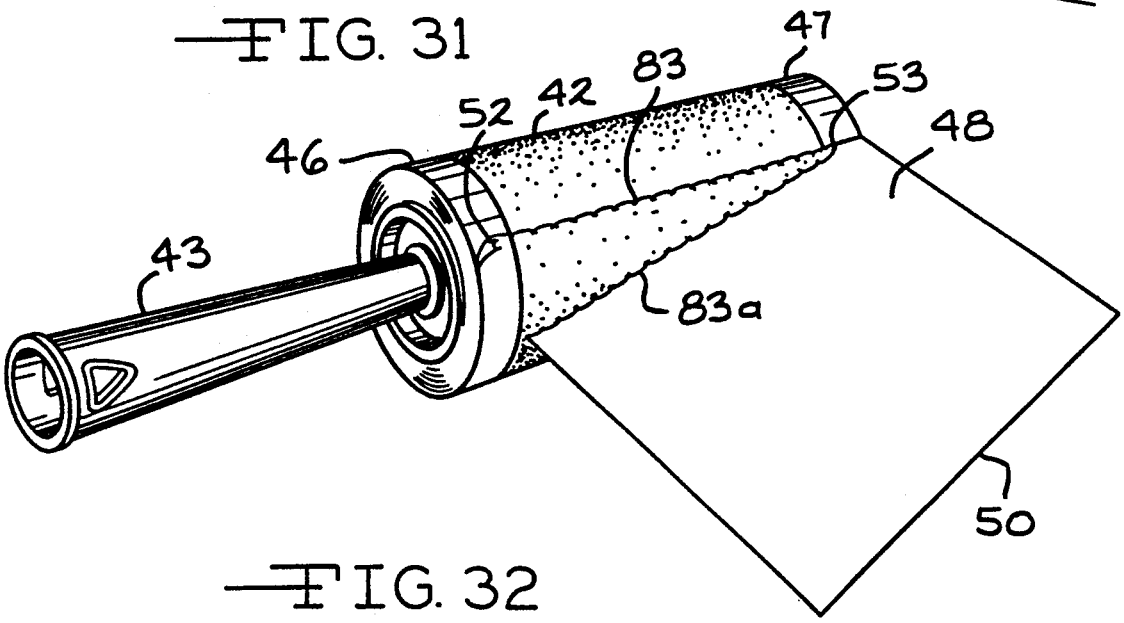
Figure 33:
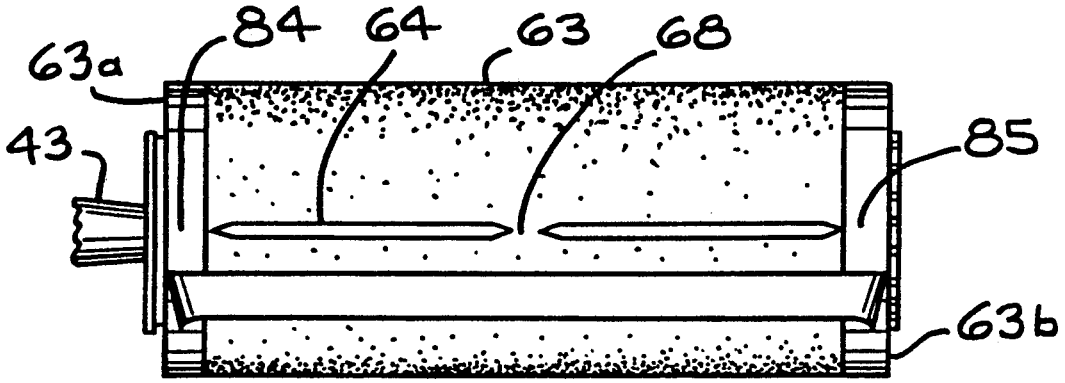
Figure 34:
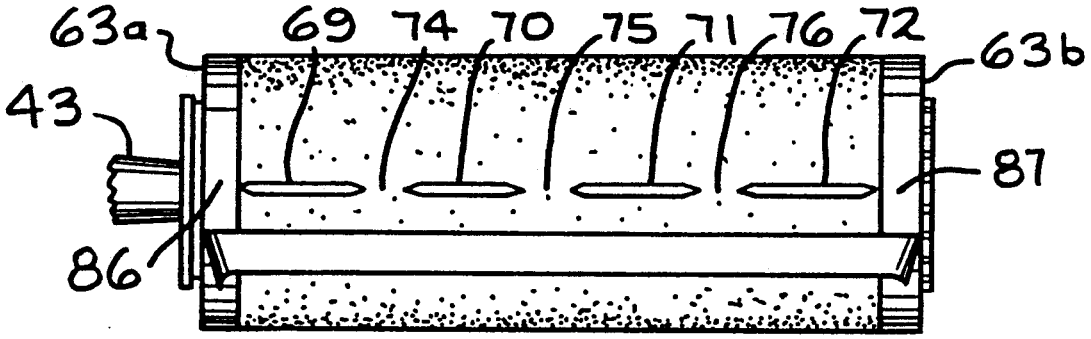
Figure 35:
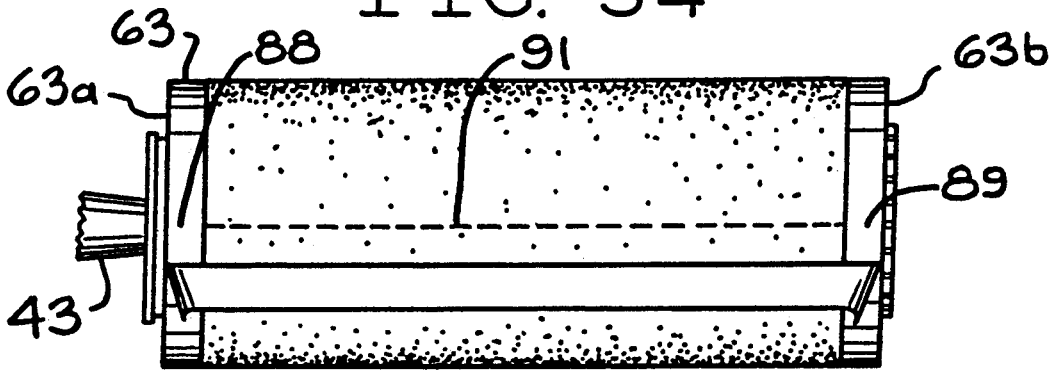
Figure 36:
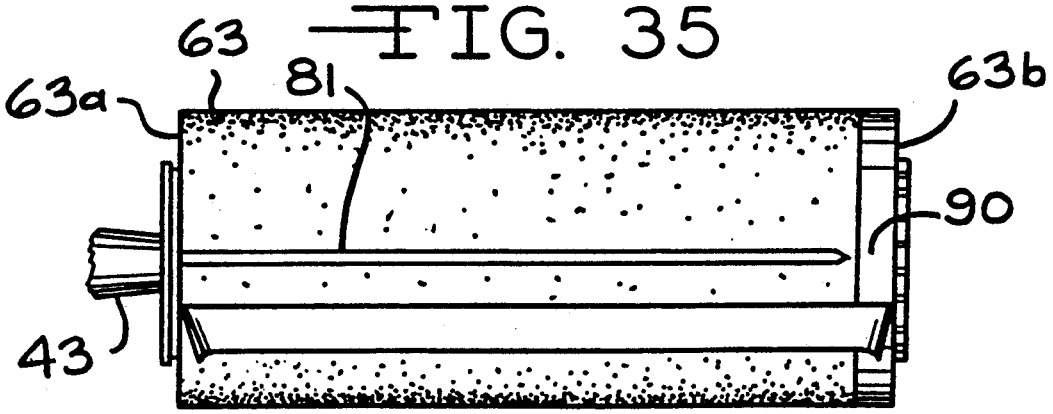

As shown in FIGS. 30 through 32, another embodiment of the lint remover roller invention is shown wherein the slit 45 is replaced by a line of perforations 83 which extends across the adhesive portion of the tape intermediate the non-adhesive side edge portions. As shown schematically in FIG. 43, the pressure sensitive adhesive tape utilized in the embodiment of the invention shown in FIGS. 30 through 32 comprises an elongate tape roll substrate 92 having a narrower centrally positioned adhesive layer 93 provided thereon extending longitudinally therealong so that non-adhesive longitudinal strip portions 92 of the tape roll substrate are provided longitudinally along each side of the tape roll. The modified pressure sensitive adhesive tape shown in FIG. 43 is then provided with a plurality of transverse spaced apart lines of perforation 83 therealong.

In use, the modified pressure-sensitive tape roll is then longitudinally wound on itself or on a tubular core 44 or 94 as shown in various embodiments of the lint remover assembly throughout the drawings. Thereafter, the lint remover assembly is utilized as described in the specification by removing each layer of tape as it becomes saturated by tearing it along the lines of perforation 83 as shown in FIGS. 30 through 32.

Another embodiment of the modified pressure-sensitive tape is shown in FIG. 42 wherein the adhesive layer 93 defines a narrow non-adhesive portion along only one side of the tape roll substrate 92 which would also be selectively wound on a tubular core 44 or 94 as desired.

A method for producing the various embodiments of the lint remover assembly is shown in FIGS. 37 through 43 wherein an elongate tape roll substrate 92 (see FIG. 37A) is provided having a partial pressure sensitive adhesive layer 93 affixed to one surface thereof so as to define at least one narrow non-adhesive portion 92 (see FIG. 37B) longitudinally along one side edge thereof. As shown in FIG. 41, the tape roll substrate 92 can have a centrally positioned adhesive layer 93 affixed thereto so as to define a narrow non-adhesive side portion 92 along each side of the tape roll substrate.

In either case, the modified pressure sensitive tape roll is then wound upon itself or a core 44 or 94 (see 37C) and then the adhesive covered portion of adhesive tape roll provided with a slit 95 provided therethrough as shown in FIGS. 37C and 38 or as shown elsewhere in the drawings. It is within the scope of the invention for the slit 95 to consist of a plurality of shorter longitudinally aligned slits.

In summary, a lint remover assembly is provided with a handle member having a lint remover roller in association therewith which is adapted to supportably receive a washable plastic based pressure sensitive adhesive tape roll thereon having layers of washable plastic based adhesive tape with the adhesive surface facing outwardly so that the washable plastic based adhesive tape roll can be selectively rolled over a surface to selectively lift lint and/or other foreign particles therefrom. The combination comprises a washable plastic based pressure sensitive adhesive tape roll having an outwardly facing adhesive surface adapted for selective mounting upon a lint remover roller. The washable plastic based pressure sensitive adhesive tape roll has at least one slit substantially therethrough. The slit extends only partially across the width of the tape roll so as to define a narrow unslit portion in the tape roll which maintains the retentive longitudinally continuous integrity of the tape roll on the lint remover roller upon which it is mounted. Each layer of the tape roll is selectively detachable upon saturation by lifting it away along the slit and tearing it away through the narrow unslit portion to expose the next lowermost unused layer. The washable plastic based pressure sensitive adhesive tape roll can be modified to have a plurality of longitudinally aligned spaced apart slits which extend partially across the width of the tape roll so as to respectively define a plurality of narrow unslit portions in the tape roll which cooperate to maintain the retentive longitudinally continuous integrity of the tape roll on the lint remover roller upon which it is mounted. Another embodiment of the pressure sensitive adhesive tape roll for selective use on a lint remover roller assembly is provided having a core. A non-adhesive tape substrate is provided which has a first portion on one side thereof covered with a longitudinally extending adhesive layer and a second portion defining a narrow uncovered substrate portion therealong. The first and second portions thereof form a pressure sensitive adhesive tape. The pressure sensitive adhesive tape is adapted for selective winding on the core with the adhesive layer of the tape facing outwardly to form a pressure sensitive adhesive tape roll. A slit is provided through the adhesive tape roll across the adhesive layer first portion thereof so as to define a narrow unslit uncovered substrate second portion which maintains the retentive longitudinally continuous integrity of the pressure sensitive tape roll on the core. Each layer of the tape roll is selectively detachable upon saturation from the adhesive tape roll by lifting it away along the slit and tearing it away through the narrow unslit portion of the substrate to expose the next lowermost unused adhesive tape layer. Another embodiment of the pressure sensitive tape roll is provided wherein the non-adhesive tape substrate comprises a plastic sheet material. Yet another embodiment of the pressure sensitive tape roll is provided wherein the longitudinally extending adhesive layer comprises a washable pressure-sensitive adhesive. A still further embodiment of the pressure sensitive tape roll is provided wherein the slit is diagonally positioned through the adhesive tape roll across the adhesive layer first portion thereof. A still further embodiment of the pressure sensitive tape roll is provided wherein the slit comprises a plurality of end-to-end longitudinally aligned spaced apart slits.

The narrow unslit side portions cooperate to maintain the retentive longitudinally continuous integrity of the tape roll on the lint remover roller upon which it is mounted.

Yet another embodiment of the washable plastic based pressure sensitive adhesive tape roll is provided with an elongate slit substantially therethrough. The slit extends from one side edge of the tape roll partially across the width of the tape roll proximate to the opposite side edge thereof so as to define a narrow unslit portion adjacent the opposite side edge. The narrow unslit portion is adapted to maintain the retentive longitudinally continuous integrity of the tape roll on the lint remover roller upon which it is mounted.

The foregoing embodiment of the washable plastic based pressure sensitive adhesive tape roll can be selectively wound upon a core sleeve which is adapted to be selectively mounted upon a lint remover roller assembly.

In closing, it should be noted that it is within the scope of all of the embodiments of this invention that any configuration and/or combination of slits can be utilized in connection with the adhesive tape roll so long as one or more unslit portions are provided in the tape roll which maintain the retentive longitudinally continuous integrity of the tape roll upon the lint remover assembly upon which it is mounted while permitting selective removal of each layer of the adhesive tape as it becomes saturated in use.

Various other modifications of the invention may be made without departing from the principle thereof. Each of the modifications is to be considered as included in the hereinafter appended claims, unless these claims by their language expressly provide otherwise.

I claim:

1. In a pressure sensitive adhesive tape roll for selective use on a lint remover roller assembly, the combination comprising:

a core;

a non-adhesive tape substrate, said tape substrate having a first portion on one side thereof covered with a longitudinally extending adhesive layer and a second portion defining a narrow uncovered substrate portion therealong, said first and second portions forming a pressure sensitive adhesive tape, said pressure sensitive adhesive tape adapted for selective winding on said core with the adhesive layer of said tape facing outwardly to form a pressure sensitive adhesive tape roll; and a slit provided through said adhesive tape roll across the adhesive layer first portion thereof to define a narrow unslit uncovered substrate second portion which maintains the retentive longitudinally continuous integrity of said pressure sensitive tape roll on said core, each layer of said tape roll being selectively detachable upon saturation from said adhesive tape roll by lifting it away along said slit and tearing it away through said narrow unslit portion of said substrate to expose the next lowermost unused adhesive tape layer.

2. In the pressure sensitive adhesive tape roll of claim 1 wherein said non-adhesive tape substrate comprises a plastic sheet material.

3. In the pressure sensitive adhesive tape roll of claim 2 wherein said longitudinally extending adhesive layer comprises a washable pressure-sensitive adhesive.

4. In the pressure sensitive adhesive tape roll of claim 1 wherein said slit is diagonally positioned through said adhesive tape roll across the adhesive layer first portion thereof.

5. In the pressure sensitive adhesive tape roll of claim 1 wherein said slit comprises a plurality of end-to-end longitudinally aligned spaced apart slits.

6. In method for producing a lint remover assembly the steps which include:

(a) providing an elongate tape roll substrate;

(b) affixing a partial pressure sensitive adhesive layer to one surface of said tape roll substrate which extends longitudinally on said tape roll substrate, said adhesive layer defining a narrow non-adhesive portion longitudinally along at least one side edge of said tape roll substrate;

(c) providing an adhesive tape roll core member;

(d) winding said tape roll substrate on said core member so that said adhesive layer affixed thereto faces outwardly to form a pressure-sensitive adhesive tape roll on said core; and (e) cutting at least one slit through the adhesive portion of said pressure-sensitive adhesive tape roll, said slit defining at least one narrow unslit non-adhesive side edge portion in said tape roll substrate.

7. In the method of claim 7 wherein said adhesive layer is affixed to said elongate substrate so as to define a narrow non-adhesive portion longitudinally along each side edge of said tape roll substrate.

8. In the method of claim 8 wherein said adhesive layer comprises a washable plastic based pressure sensitive adhesive material.

9. In method for producing a lint remover assembly the steps which include:

(a) providing an elongate tape roll substrate;

(b) affixing a partial pressure sensitive adhesive layer to one surface of said tape roll substrate which extends longitudinally on said tape roll substrate, said adhesive layer defining a narrow non-adhesive portion longitudinally along at least one side edge of said tape roll substrate;

(c) providing a plurality of transverse spaced apart lines of perforation through said adhesive layer portion of said tape roll substrate positioned therebelow;

(d) providing an adhesive tape roll core member; and (e) winding said tape roll substrate on said core member so that said adhesive layer affixed thereto faces outwardly to form a pressure-sensitive adhesive tape roll on said core.

10. In the method of claim 9 wherein said adhesive layer is affixed to said elongate substrate so as to define a narrow non-adhesive portion longitudinally along each side edge of said tape roll substrate.

11. In the method of claim 9 wherein said adhesive layer comprises a washable plastic based pressure sensitive adhesive material.

* * * * *